United States Patent [19]

Fergg et al.

[11] 3,946,507

[45] Mar. 30, 1976

[54] LABEL FOR USE ON CONTAINERS FOR PHOTOGRAPHIC FILM OR THE LIKE

[75] Inventors: Berthold Fergg; Wolfgang Zahn, both of Munich; Friedrich Hujer, Grunwald, all of Germany

[73] Assignee: AGFA-Gevaert AG, Leverkusen, Germany

[22] Filed: June 27, 1974

[21] Appl. No.: 483,670

Related U.S. Application Data

[62] Division of Ser. No. 248,126, April 27, 1972, Pat. No. 3,841,936.

[30] Foreign Application Priority Data

Apr. 30, 1971 Germany ..... 2121499

[52] U.S. Cl. ..... 40/2 R

[51] Int. Cl.[2] ..... A44C 3/00

[58] Field of Search ..... 40/359, 360, 2, 23, 23 A, 40/125 A; 229/74

[56] References Cited

UNITED STATES PATENTS

| | | | |
|---|---|---|---|
| 1,541,459 | 6/1925 | Ahrnke | 40/2 R |
| 1,840,143 | 1/1932 | Wendl | 40/2 R |
| 2,324,777 | 7/1943 | Holmstrom | 40/2 R X |
| 2,893,144 | 7/1959 | Cunnigham | 40/2 R |
| 3,001,306 | 9/1961 | Wilkinson | 40/360 |
| 3,400,477 | 9/1968 | Brown | 40/10 R |

FOREIGN PATENTS OR APPLICATIONS

| | | | |
|---|---|---|---|
| 1,101,190 | 3/1955 | France | 40/310 |

*Primary Examiner*—Louis G. Mancene
*Assistant Examiner*—Wenceslao J. Contreras
*Attorney, Agent, or Firm*—Michael J. Striker

[57] ABSTRACT

A rectangular label wherein a rectangular central portion is disposed between two rectangular sections having their rear sides provided with coats of adhesive. The front side of the central label portion bears imprinted information pertaining to the cost of developing of photographic film, the number of prints to be made from film, the price per print, the nature of film and/or the size of each print. The adhesive-coated sections are partially separated from the central portion by rows of perforations so that the central portion can be completely separated from the sections while the sections adhere to an envelope in order to at least partially close an open end of the envelope. Additional information may be imprinted onto the front side of at least one section to remain on the envelope, either as a bill to the dealer or as a bill to the customer. At least one of the adhesive-coated sections is provided with a fold line so that it can be readily folded over the open end of an envelope.

8 Claims, 4 Drawing Figures

LABEL FOR USE ON CONTAINERS FOR PHOTOGRAPHIC FILM OR THE LIKE

This is a division of application Ser. No. 248,126, filed on Apr. 27, 1972, now U.S. Pat. No. 3,841,936.

BACKGROUND OF THE INVENTION

The present invention relates to adhesive-coated labels in general, and more particularly to improvements in labels which are provided with information or data and can be permanently or temporarily bonded to an article.

It is already known to employ adhesive-coated labels on articles in stores and to apply to the front sides of such labels information which can indicate the cost of articles, the dimensions of articles or the like. Furthermore, it is customary to use imprinted adhesive-coated labels on parcels and/or on envelopes which are to be mailed by a mail order house or a similar institution. However, adhesive-coated labels are not used at present in connection with the storage and/or shipment of photographic film and/or prints of film frames.

Labels which somewhat resemble the label of the present invention are disclosed in German Printed Publication No. 2,027,378 published Dec. 10, 1970.

SUMMARY OF THE INVENTION

An object of the invention is to provide a novel and improved label which can be used with particular advantage on envelopes or analogous containers for photographic film and/or photographic prints.

On feature of the invention resides in the provision of a label which comprises a first portion the rear side of which is coated with adhesive and which preferably consists of two spaced apart rectangular sections, a second portion which is preferably located between the sections of the first portion and the front portion of which is provided with information or data pertaining, for example, to a transaction in connection with the development of photographic film and/or the making of prints, and a weakened portion which is disposed between the first and second portions and preferably consists of two rows of perforations allowing convenient separation of the second portion from the first portion while the first portion adheres to an envelope or the like in such a way that the open end of the envelope is overlapped and at least partially closed by the first portion.

The novel features which are considered as characteristic of the invention are set forth in particular in the appended claims. The improved label itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
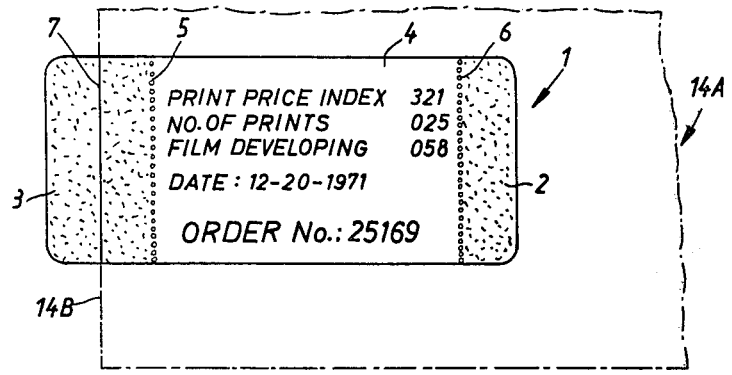
FIG. 1 is a front elevational view of a label which embodies one form of the invention, further showing a portion of an envelope to which the label is about to be bonded.

Referring first to FIG. 1, there is shown a rectangular label 1 which comprises a substantially centrally located non-adherent rectangular portion 4 which is provided with imprinted information or data, and another portion consisting of two adherent adhesive-coated rectangular marginal sections 2 and 3. The sections 2 and 3 (hereinafter called strips, for short) are disposed at the opposite sides of the central portion 4 and are adjacent to the short edges of the label 1. For the sake of clarity, the coats of adhesive are shown as being applied to the front or exposed sides of the strips 2 and 3; however, such adhesive coats are actually applied to those sides of the strips which face away from the observer of FIG. 1. The adhesive coats on the rear sides of the strips 2 and 3 preferably consist of a pressure-responsive adhesive which will strongly adhere to paper or a similar material in response to the application of moderate pressure. Neither side of the central portion 4 is coated with an adhesive. However, the rear side of the central portion 4 could be coated with a moisture-activatable adhesive which does not adhere to paper or the like without previous application of water.

The width of the strip 2 is about half the width of the strip 3, and the strip 3 is provided with a fold line 7 along which the outer part of the strip 3 can be readily folded over the inner part. The central portion 4 is separated from the strips 2 and 3 by an elongated weakened portion consisting of two rows of perforations respectively numbered 6 and 5. Thus, when the rear sides of the strips 2 and 3 adhere to a surface of a paper envelope or the like, the central portion 4 can be readily separated therefrom by tearing it away along the rows of perforations 5 and 6. As a rule, the width of the strip 3 will be at least twice the width of the strip 2.

The information or data which is imprinted onto the front side of the central portion 4 is self-explanatory. The label 1 is assumed to be utilized by a dealer in photographic material who accepts exposed and/or developed films for development and/or for the making of prints. The first line of information which is imprinted on the central portion 4 indicates the price index per print. The second line indicates the number of prints which are to be made, and the third line represents the code number for the developing of film, i.e., encoded information pertaining to the cost of development. The fourth line indicates the date on which the film was accepted for processing, and the last line indicates the order number which is different from label to label. When a clerk in a shop accepts an exposed film from the customer, the film is inserted into an envelope 14A and the label 1 is thereupon applied to one side of the envelope 14A adjacent to the open side or end which is indicated at 14B. The application of the label 1 is preferably such that the open end 14B registers with the fold line 7 whereby the rear sides of the strip 2 and of the inner part of the strip 3 adhere to one side of the envelope 14A. The clerk thereupon folds the outer part of the strip 3 over the open side 14B of the envelope 14A so that the strip 3 is folded along the line 7 and the outer part of the strip 3 adheres to the rear side of the envelope which provides a temporary closure for the envelope and confines the exposed film in its interior. The envelope 14A is then delivered or shipped to the developing plant where the film is developed and/or prints are made therefrom.

Certain information which appears at the front side of the central portion 4 of the label 1 can be applied (imprinted) thereto prior to attachment of the label to an envelope. Such information includes that which is in lines 1, 3 and 5 shown at the front side of the central portion 4. The number of prints (in the illustrated embodiment, the number of prints to be made is 25) is applied by the clerk. The same holds true for the date when the film was accepted for development and/or printing. In fact, certain information which appears on the central portion 4 can be imprinted on the label 1 prior to application of coats of adhesive to the rear sides of the strips 2 and 3. Such information may include the print price index, the number of prints, the cost of developing, the date and the order number. The label 1 can be attached with a large number of similar labels to an elongated carrier web of wax paper or the like to which the adhesive at the rear sides of the strips 2 and 3 adheres but can be readily separated therefrom without affecting the condition of the adhesive coats. Certain information on the central portion 4 can be imprinted onto the labels 1 prior to attachment to the carrier web of wax paper or the like. Certain other information, such as the order numbers, can be applied to the labels after they are attached to wax paper so that consecutive labels will be provided with successive order numbers, such as 25 169, 25 170, 25 171, etc. The carrier of wax paper can be introduced into an automatic printing machine which applies the order numbers in the desired sequence. The same holds true for the code number of the print price index and the cost of film developing.

Figure 2:
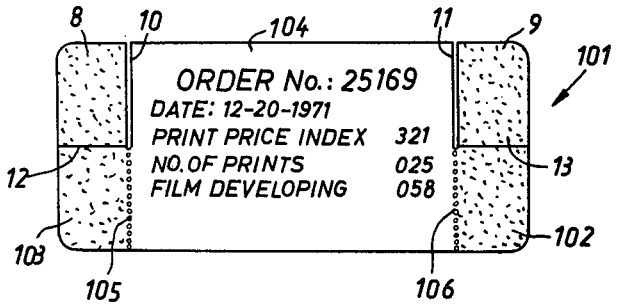
FIG. 2 is a front elevational view of a second label.

FIG. 2 illustrates a modified label 101. This label also comprises a non-adherent central portion 104 which is flanked by two marginal sections or strips 102, 103 of another label portion the rear side of which is coated with a suitable pressure-activatable adhesive. The width of the strip 102 is shown as being equal to that of the strip 103, and each of these strips is provided with a transversely extending fold line 13, 12. The rows of perforations which extend between the central portion 104 and the lower parts of the strips 102, 103 are respectively shown as 106 and 105. The label 101 is further provided with two narrow slits 10 and 11 which respectively separate the upper parts of the strips 103 and 102 from the adjoining parts of the central portion 104. The parts 8 and 9 which are respectively located above the fold lines 12 and 13 constitute two flaps which can be folded along the lines 12 and 13 so as to adhere to the rear side of an envelope to the front side of which the label 101 is applied by means of adhesive which coats the lower parts of the strips 102 and 103.

Figure 3:
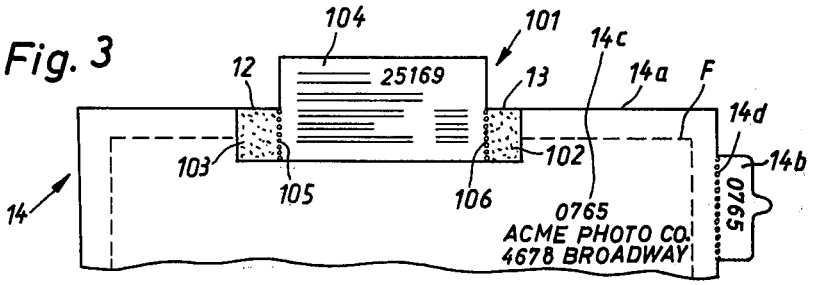
FIG. 3 is a fragmentary front elevational view of an envelope, further showing on the envelope the label of FIG. 2.

FIG. 3 illustrates an envelope or container 14 of the type which is often employed by dealers in photographic material or the like for mailing of exposed photographic films to the developing and printing plants. The illustrated envelope 14 is provided with a tab **14*b* which can be detached along the line 14*d* and handed to the customer as a receipt for the delivered film. The number which appears on the tab 14*b* is also applied to the envelope 14, as at 14*c*, together with additional information such as the name of the dealer and his address. The reference character 14*d* can indicate a row of perforations or an otherwise weakened portion of the tab 14*b* which can be readily separated from the major part of the envelope 14 and handed to the customer. If desired, the number on the tab 14*b* and the corresponding number on the face of the envelope 14** can appear in a coded form. Each envelope is provided with a different number.

When the envelope 14, with the tab **14*b* already removed therefrom and with a roll of exposed but undeveloped film contained therein, is received by the developing plant, the envelope is opened up preferably by severing or removing a narrow portion along the edge 14*a* so that the exposed film can be removed therefrom. Such film is normally stored in a suitable cassette. Once the exposed film is removed from the envelope 14, it is provided with a code number for identification in the developing plant, and such code number remains on the film during the processing which may include development and the making of a requisite number of prints. When the developing and printing operation is completed, the thus obtained prints and the exposed and developed film are delivered or automatically conveyed to a station where the number of prints is counted, where the dimensions of the prints are determined, and where a notation is made of the nature of film which was developed and further processed. The just-mentioned information can be obtained automatically by suitable equipment which is well known in the art. Certain information may be obtained by visual inspection or counting, and such information may be fed into a printing device similar to a typewriter which applies the information to labels 101 of the type shown in FIG. 2. At this station, the label 101 which is subsequently applied to the envelope 14 is also provided with the date which can be imprinted onto the central portion 104. Furthermore, the person in charge at such station may apply to the label 101 the order number which can also represent the commission number of the particular merchant. Such order number can be applied in the form of numerals or in encoded form. The exposed and developed film is preferably severed so as to form sections of desired length. For example, each such section may include six film frames. The sections of film and the prints are thereupon inserted into the envelope 14 and the label 101 is applied to the open end 14*a* of the envelope in a manner as shown in FIG. 3. Thus the flaps 8 and 9 are folded along the lines 12 and 13 so that they adhere to the rear side of the envelope 14 whereas the lower parts of the strips 102, 103 adhere to the front side of the envelope. The flaps 8 and 9 thereby partially seal the open end of the envelope so as prevent unintentional removal or escape of film sections and prints. FIG. 3 further shows that the upper part of the central label portion 104 extends beyond the open end 14*a* so that the order number, which happens to be 25 169, can be readily observed even if the envelope 14 is thereupon inserted into a drawer or a box, together with a number of similar envelopes, in such a way that the upper parts of the label portions 104 extend from the drawer or box. The envelopes 14 are then returned to the dealer and are held in readiness for the customer or customers. The customer presents his tab 14*b*** and the number thereon is compared with the number on the envelope so that the dealer makes sure that the customer receives his film and proper prints.

It will be noted that, in contrast to the application of the label 1 shown in FIG. 1, the label 101 of FIG. 2 can be applied to the envelope 14 in such a way that the upper part of its central portion 104 extends beyond the open end **14*a* of the envelope. This is desirable because the order numbers can be readily observed without even partial withdrawal of envelopes from their drawer or box. Not only the label 1 but also the label 101 is attached to the respective envelope 14A or 14 with sufficient force to prevent any unintentional or accidental separation. This can be readily achieved by applying to the strips 2, 3 or 102, 103** a moderate pressure so that the adhesive coats at the rear sides of such strips properly adhere to the adjacent portions of the respective envelopes.

Once the dealer has located the envelope 14 which belongs to a particular customer, the envelope is withdrawn from its receptacle and the central portion 104 is separated from the envelope by destroying the rows of perforations 105 and 106. The information which is applied to the front side of the thus separated central portion 104 is evaluated to determine the cost to the customer. Alternatively, the thus separated portion 104 can be kept for later billing of a particular customer. The portion 104 is thereupon retained in the files of the merchant in proof of completion of the transaction.

Figure 4:
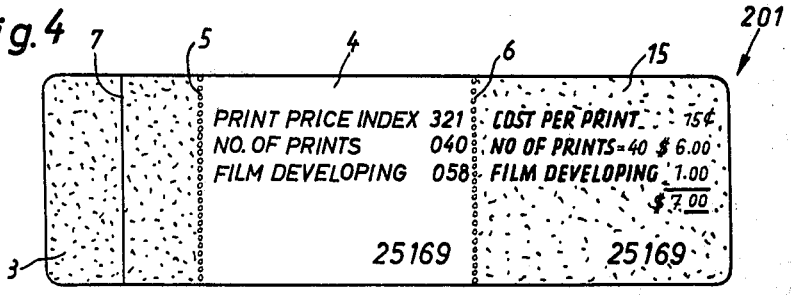
FIG. 4 is a front elevational view of a third label.

FIG. 4 illustrates a third label 201 which is similar to the label 1 of FIG. 1 and certain parts of which are denoted by similar reference characters. The difference between the labels 1 and 201 is that the latter comprises a relatively wide adhesive-coated adherent section 15 which replaces the relatively narrow strip 2 of FIG. 1. The area of the section 15 is shown as being substantially equal to that of the non-adherent central portion 4. The label 201 is assumed to be applied to an envelope in the printing and developing plant. When the envelope with the label 201 thereon is returned to the dealer, the dealer retains the central portion 4 which is separated from the remainder of the label along the rows of perforations 5 and 6. The portion 4 then constitutes a receipt which the dealer retains in proof of completion of the transaction. The information which is imprinted on the section 15 remains on the envelope and is handed to the customer. Such information on the section 15 constitutes a bill which can be paid immediately or later on. The information which is shown at the front side of the marginal portion 15 can be imprinted in the developing and processing plant if the personnel at the plant is aware of the billing practice of the particular dealer. Alternatively, the developing plant will retain the central portion 4 as a receipt for completion of the transaction and the information which is imprinted on the section 15 will constitute a bill to the dealer. It is clear that the improved label is susceptible of many additional modifications without departing from the spirit of the invention. For example, the front sides of the adhesive coated marginal sections of each label can be provided with advertising matter or with other pertinent information. Furthermore, the improved label need not necessarily be used as a means for forming a closure for an open-ended or open-sided envelope which contains exposed but undeveloped film and/or developed film and/or prints. For example, the open end of an envelope can be sealed or partially sealed by a discrete label which does not bear any information or is provided only with advertising matter. The label 1, 101 or 201 is then applied to any other part of the envelope where it can be readily seen by the dealer. However, the simultaneous utilization of the label as a carrier of information as well as a means for at least partially closing an envelope or an analogous container for undeveloped or developed film and prints has been found to be of particular advantage because it saves an additional operation, namely, the sealing or closing of the open end of an envelope by a separate label or by a staple.

It is further clear that the improved label can find advantageous use in many other plants, not necessarily in photoshops or developing plants for photographic film or the like. For example, the label can be applied to envelopes which contain watches to be sent to a repair shop as well as any other relatively small articles which are to be transported or shipped between a receiving station, such as a dealer, and a repairing or processing station.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and the range of equivalence of the claims.

What is claimed as new and desired to be protected by Letters Patent is set forth in the appended claims:

1. The combination of an envelope having an open end, particularly for insertion of photographic film and/or prints, with a label having a first side and a second side and comprising a first portion including two spaced-apart sections each provided with a coat of adhesive at one side of the label, said label further comprising a second portion disposed between and separating said sections for each other, said second portion having information applied thereto so that such information is observable at the other side of the label and said second portion being non-adherent at said one side of the label, said label also comprising weakened portions disposed between said second portion and said sections to facilitate the separation of said second portion from said sections and a fold line provided in at least one of said sections and dividing said one section into first and second parts, said one section being folded along said fold line so that said first and second parts overlap each other and the adhesive coat of said one section is located between said parts, said parts adhering to said envelope at the opposite sides of said open end so that said one section at least partially closes said open end, the other of said sections also adhering to said envelope.

2. The combination of claim 1, wherein said label is rectangular and each of said weakened portions includes a row of perforations.

3. The combination of claim 2, wherein at least one of said sections is a strip.

4. The combination of claim 1, wherein said label has elongated slits one of which separates one part of said one section from said second portion and the other of which separates a part of said other section from said second portion.

5. The combination of claim 4, wherein said fold line is substantially normal to said one slit.

6. The combination of claim 1, wherein the area of said one section is greater than the area of said other section, said fold line being substantially parallel to the weakened portion between said second portion and said one section.

7. The combination of claim 1, wherein the area of said other section is at least substantially equal to the area of said second portion, said other section being provided with additional information which is observable at said other side of said label.

8. The combination of claim 1, wherein both sides of said section portion are without adhesive coats.

* * * * *